US011090712B2

(12) United States Patent
Eakins et al.

(10) Patent No.: US 11,090,712 B2
(45) Date of Patent: Aug. 17, 2021

(54) METHOD OF MANUFACTURING A HYBRIDIZED CORE WITH PROTRUDING CAST IN COOLING FEATURES FOR INVESTMENT CASTING

(71) Applicants: Siemens Aktiengesellschaft, Munich (DE); Mikro Systems, Inc., Charlottesville, VA (US)

(72) Inventors: Roy Eakins, Madison, VA (US); Gary B. Merrill, Orlando, FL (US)

(73) Assignees: Siemens Energy Global GmbH & Co. KG, Munich (DE); Mikro Systems, Inc., Charlottesville, VA (US)

( * ) Notice: Subject to any disclaimer, the term of this patent is extended or adjusted under 35 U.S.C. 154(b) by 553 days.

(21) Appl. No.: 16/077,825

(22) PCT Filed: Mar. 24, 2016

(86) PCT No.: PCT/US2016/023874

§ 371 (c)(1),
(2) Date: Aug. 14, 2018

(87) PCT Pub. No.: WO2017/164874

PCT Pub. Date: Sep. 28, 2017

(65) Prior Publication Data

US 2021/0187595 A1 Jun. 24, 2021

(51) Int. Cl.

| | |
|---|---|
| ***B22C 9/10*** | (2006.01) |
| ***B22C 9/12*** | (2006.01) |
| ***B22C 9/22*** | (2006.01) |
| ***B22C 9/24*** | (2006.01) |

(52) U.S. Cl.
CPC ..... *B22C 9/103* (2013.01); *B22C 9/12* (2013.01); *B22C 9/22* (2013.01); *B22C 9/24* (2013.01)

(58) Field of Classification Search
CPC ..... B22C 9/10; B22C 9/103; B22C 9/108; B22C 9/12; B22C 9/24
See application file for complete search history.

(56) References Cited

U.S. PATENT DOCUMENTS

| | | | | |
|---|---|---|---|---|
| 6,557,621 | B1 | 5/2003 | Dierksmeier et al. | |
| 2005/0274478 | A1* | 12/2005 | Verner | B22C 21/14 164/45 |
| 2006/0032604 | A1* | 2/2006 | Beck | B22C 9/00 164/361 |
| 2013/0333855 | A1* | 12/2013 | Merrill | B22C 9/02 164/45 |
| 2013/0341822 | A1 | 12/2013 | Ellgass et al. | |

FOREIGN PATENT DOCUMENTS

| | | | |
|---|---|---|---|
| EP | 0715913 | A1 | 6/1996 |
| GB | 2096523 | A | 10/1982 |
| WO | 2013163150 | A1 | 10/2013 |

OTHER PUBLICATIONS

PCT International Search Report and Written Opinion dated Nov. 23, 2016 corresponding to PCT Application No. PCT/US2016/023874 filed Mar. 24, 2016.

* cited by examiner

*Primary Examiner* — Kevin E Yoon

(57) ABSTRACT

A method of manufacturing protruding cast in features (10). At least one core insert (12) is manufactured using small particle sizes. A bulk core body is manufactured using large particle sizes. The at least one core insert (12) and bulk core body are fully fired separately. The at least one core insert (12) is bonded with the bulk core body.

5 Claims, 2 Drawing Sheets

METHOD OF MANUFACTURING A HYBRIDIZED CORE WITH PROTRUDING CAST IN COOLING FEATURES FOR INVESTMENT CASTING

BACKGROUND

1. Field

The present invention relates to a method of manufacturing a hybridized core with protruding cast in cooling features for investment casting.

2. Description of the Related Art

In gas turbine engines, compressed air discharged from a compressor section and fuel introduced from a source of fuel are mixed together and burned in a combustion section, creating combustion products defining a high temperature working gas. The working gas is directed through a hot gas path in a turbine section of the engine, where the working gas expands to provide rotation of a turbine rotor. The turbine rotor may be linked to an electric generator, wherein the rotation of the turbine rotor can be used to produce electricity in the generator.

In view of high pressure ratios and high engine firing temperatures implemented in modern engines, certain components, such as airfoils, e.g., stationary vanes and rotating blades within the turbine section, must be cooled with cooling fluid, such as air discharged from a compressor in the compressor section, to prevent overheating of the components.

Effective cooling of turbine airfoils requires delivering the relatively cool air to critical regions such as along the trailing edge of a turbine blade or a stationary vane. The associated cooling apertures may, for example, extend between an upstream, relatively high pressure cavity within the airfoil and one of the exterior surfaces of the turbine blade. Blade cavities typically extend in a radial direction with respect to the rotor and stator of the machine.

Airfoils commonly include internal cooling channels which remove heat from the pressure sidewall and the suction sidewall in order to minimize thermal stresses. Achieving a high cooling efficiency based on the rate of heat transfer is a significant design consideration in order to minimize the volume of coolant air diverted from the compressor for cooling. However, the relatively narrow trailing edge portion of a gas turbine airfoil may include, for example, up to about one third of the total airfoil external surface area. The trailing edge is made relatively thin for aerodynamic efficiency. Consequently, with the trailing edge receiving heat input on two opposing wall surfaces which are relatively close to each other, a relatively high coolant flow rate is entailed to provide the requisite rate of heat transfer for maintaining mechanical integrity.

Current methods of manufacturing turbine airfoils, such as those in the power industry, include providing a core for a casting process. The cores for casting, investment casting typically, are being developed with protruding cast in cooling features for aero applications. Typically these cores are small and can be manufactured with smaller particles than the particles that are typically used for larger industrial gas turbine (IGT) cores. Problems arise in this process with scaling. Larger particles used in IGT cores, for example, can be destructive when processing the fine features required for cast in protruding features. The shrink rate of the smaller cores with finer particles is greater than the shrink rate of the larger IGT cores. When providing a material substitution at one hundred percent the shrink rate of the finer particle core material is too large and creates structural instability if there is a large core.

With improved modeling capability, designers are exploring the possibility of geometric cooling holes in blades and vanes that can offer superior cooling capacity and film distribution across the surface of an airfoil. The above described technology approach is incapable of producing such features.

SUMMARY

In one aspect of the present invention, a method of manufacturing protruding cast in features, the steps comprises: manufacturing at least one core insert using small particle sizes; manufacturing a bulk core body using large particle sizes; fully firing the at least one core insert and bulk core body separately; and bonding the at least one core insert with the bulk core body.

These and other features, aspects and advantages of the present invention will become better understood with reference to the following drawings, description and claims.

BRIEF DESCRIPTION OF THE DRAWINGS

The invention is shown in more detail by help of figures. The figures show preferred configurations and do not limit the scope of the invention.

DETAILED DESCRIPTION

Figure 1:
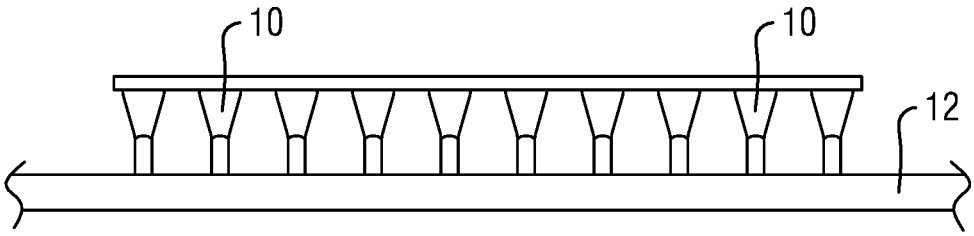
FIG. 1 is a detailed front view of an insertable ladder with geometric shaped protrusions for cast in cooling features of an exemplary embodiment of the present invention.

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Broadly, an embodiment of the present invention provides a method of manufacturing protruding cast in features. At least one core insert is manufactured using small particle sizes. A bulk core body is manufactured using large particle sizes. The at least one core insert and bulk core body are fully fired separately. The at least one core insert is bonded with the bulk core body.

Within the power industry, gas turbine engines are required to provide movement to produce electricity in a generator. In gas turbine engines, compressed air discharged from a compressor section and fuel introduced from a source of fuel are mixed together and burned in a combustion section, creating combustion products defining a high temperature working gas. The working gas is directed through a hot gas path in a turbine section of the engine, where the working gas expands to provide rotation of a turbine rotor.

The turbine rotor may be linked to an electric generator, wherein the rotation of the turbine rotor can be used to produce electricity in the generator.

Modern engines and certain components such as airfoils, e.g. stationary vanes and rotating blades within the turbine section, implement high pressure ratios and high engine firing temperatures. As advancements are made, components are seeing higher and higher temperatures and require more and more expensive materials to produce these components.

As trailing edges on turbine blades become more advanced and fine feature based, the manufacturing of these airfoils and the costs involved become more important. The ability to provide advanced cooling hole geometry allows for a reduced cost and time savings. Components are typically made from ceramic cores. For the purposes of this application, any reference to a ceramic material may also be any other material that functions in a similar fashion. Further, the reference to turbines and the power industry may also be for other processes and products that may require a core made from a casting process. Producing a blade can require first a production of a mold. The mold is produced from a master tooling surface.

Effective cooling of turbine airfoils requires delivering the relatively cool air to critical regions such as along the trailing edge of a turbine blade or a stationary vane. The associated cooling apertures may, for example, extend between an upstream, relatively high pressure cavity within the airfoil and one of the exterior surfaces of the turbine blade. Blade cavities typically extend in a radial direction with respect to the rotor and stator of the machine.

A hybridized manufacturing of a core with cast in cooling features manufactured in discrete areas is desirable. Embodiments of the present invention provide a method of manufacturing that may allow for localized increase in core strength. The turbine blade and airfoil are used below as an example of the method; however, the method may be used for any component requiring detailed features along a core for casting purposes. The turbine blade can be within the power generation industry.

The method and tooling assembly mentioned below may be in conjunction with a process that starts with a 3D computer model of a part to be created. From the model a solid surface is created from which a flexible mold can be created that is used in conjunction with a second mating flexible mold to form a mold cavity. The flexible mold is created from a machined master tool representing roughly fifty percent of the surface geometry of the core to be created. From such a tool, a flexible transfer mold can be created. In order to form a mold cavity, a second half of the master tool that creates a second flexible transfer mold, can be combined with the first flexible transfer mold to form the mold cavity. From such a mold cavity a curable slurry can be applied to create a three dimensional component form. An example of such a form can be a ceramic core used for investment casting.

In certain embodiments, such as a ceramic core used for investment casting, materials of construction can be specifically selected to work in cooperation with the casting and firing processes to provide a core that overcomes known problems with prior art cores. The materials and processes of embodiments of the present invention may result in a ceramic body which is suitable for use in a conventional metal alloy casting process.

In certain embodiments, forming ceramic cores require first producing a consumable preform or internal mold geometry. A wax preform is then placed into a mold and ceramic slurry is injected around the preform. The ceramic slurry is dried to a green state and then removed from the mold and placed into a furnace for firing of the green body to form the ceramic core.

Figure 2:
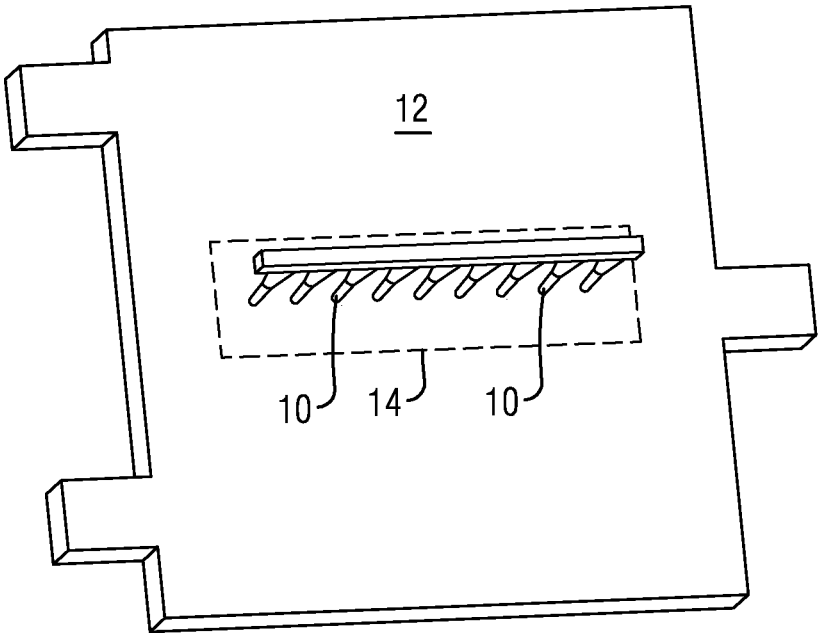
FIG. 2 is a front view of an insertable geometry for protruding cast in features in an exemplary embodiment of the present invention.
Figure 3:
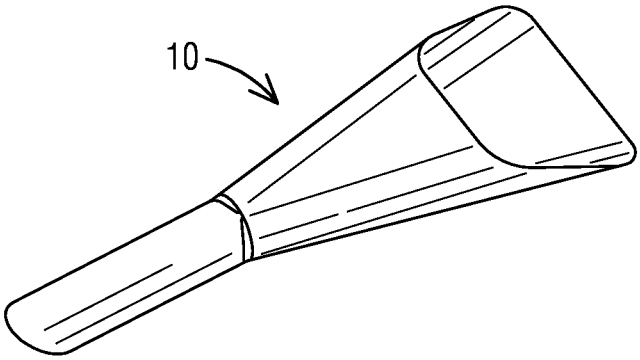
FIG. 3 is a perspective view of advanced cooling hole geometry of an exemplary embodiment of the present invention.
Figure 4:
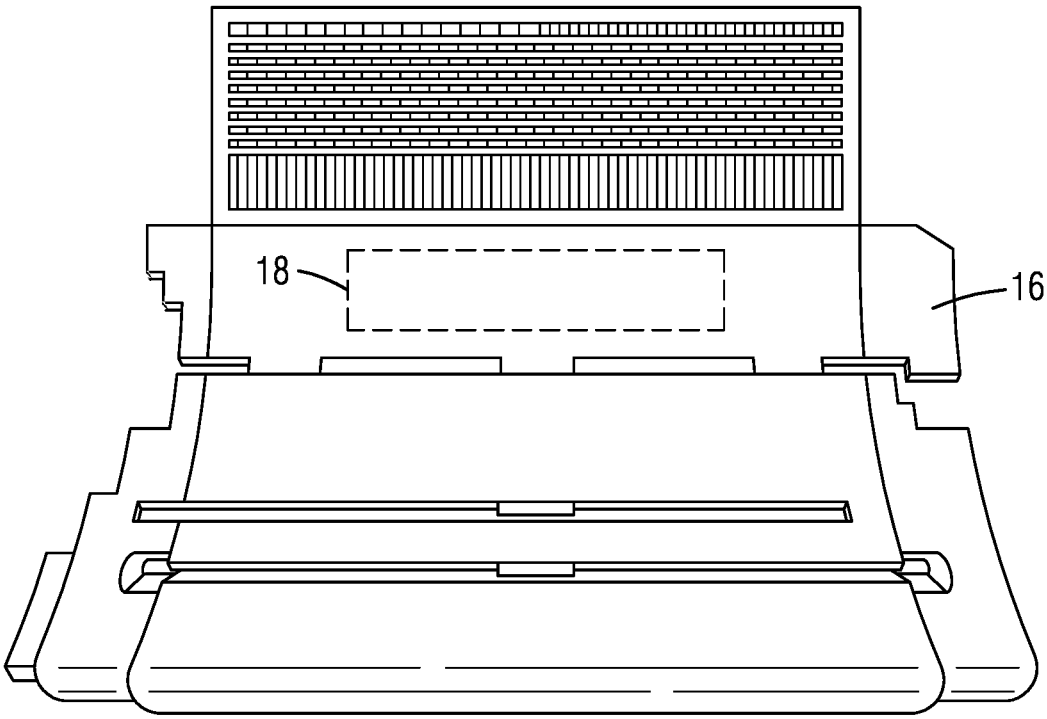
FIG. 4 is a perspective view of a bulk core body of an exemplary embodiment of the present invention.

As is illustrated in FIGS. 1 through 3, a manufacturing method for protruding cast in features 10 may include creating at least one core insert 12 separately from the creating of a bulk core body. The at least one core insert 12 and the bulk core body will have different processing shrinkage initially. This initial different process shrinkage for the at least one core insert 12 and the bulk core body relate to the size of the particles used for each component. The at least one core insert 12 may be produced with small particles size of approximately 2 to 75 microns to define the protruding cast in features 10. The bulk core body may be produced with large particle size of approximately 5 to 250 microns. Both the at least one core insert 12 and the bulk core body may continue through manufacturing separately. The at least one core insert 12 and the bulk core body may go through a firing portion of the process separately. Once fully fired, the at least one core insert 12 and the bulk core body will have similar composition and shrinkage behavior.

The original shrinkage mismatch between the at least one core insert 12 and the bulk core body is removed post firing. The at least one core insert 12 and the bulk core body may then be bonded together. The at least one core insert 12 may be manufactured in discrete areas and applied to the bulk core body. The at least one core insert 12 and the bulk core body may be bonded using an inorganic binder and subject to a partial sintering to stabilize the at least one core insert 12 relative to the bulk core body.

Firing the at least one core insert 12 and the bulk core body separately improves the robustness of the fragile protruding features 10. The protruding cast in features 10 may be used for cooling the core when in use. An example of a core insert 12 is shown in FIG. 2 with FIG. 3 showing an example of a detail advanced cooling hole geometry 14 found in the protruding cast in feature 10. The example in FIG. 2 may be used for a ladder type of configuration as shown in FIG. 1. The ladder type configuration may be provided as a reinforcing element to the protruding features. The configuration may be drawn in different geometries but serves the same purpose of holding the weak protruding features together so that they may more effectively survive the force of liquid metal when applied to the casting mold.

Ultimately the at least one core insert 12 and the bulk core body combine to create a core. A shell will surround the core. The core and shell material are not matched. An excess space relating to an outer surface of an airfoil, for example, will be filled by the core material. The core material will create a machinable internal surface that can be machined back after casting to expose the outer surface shape feature of the hole. This will be detached from the shell during casting and therefore free of any stress driven mismatch. An example of this type of structure can be seen in FIG. 1. In certain embodiments holes are completed by a punch through of the material of an internal wall of the cast.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof

What is claimed is:

1. A method of manufacturing protruding cast in features, the method comprising:

creating at least one core insert using particle sizes of 2 to 75 microns;

creating a bulk core body using particle sizes of 5 to 250 microns, wherein the particles sizes of the at least one core insert is smaller than the particle sizes of the bulk core body;

fully firing the at least one core insert and bulk core body separately; and bonding the at least one core insert with the bulk core body post firing.

2. The method according to claim 1, wherein the bonding is with an inorganic binder.

3. The method according to claim 1, further comprising the step of partially sintering the at least one core insert and bulk core body together to stabilize the combination.

4. The method according to claim 1, further comprising the step wherein holes are completed by a punch through of a material of an internal wall of a cast for the protruding cast in features.

5. The method according to claim 1, wherein the at least one core insert comprises a ladder configuration.

* * * * *